US011591988B2

(12) United States Patent
Czajkowski et al.

(10) Patent No.: US 11,591,988 B2
(45) Date of Patent: Feb. 28, 2023

(54) THROTTLE PLATE

(71) Applicant: Vitesco Technologies USA, LLC, Auburn Hills, MI (US)

(72) Inventors: Julian Czajkowski, Chatham (CA); Donald Taylor, Chatham (CA); Mohammed Rizwan Khan, Chatham (CA)

(73) Assignee: VITESCO TECHNOLOGIES USA, LLC, Auburn Hills, MI (US)

( * ) Notice: Subject to any disclaimer, the term of this patent is extended or adjusted under 35 U.S.C. 154(b) by 0 days.

(21) Appl. No.: 17/198,697

(22) Filed: Mar. 11, 2021

(65) Prior Publication Data

US 2021/0285405 A1 Sep. 16, 2021

Related U.S. Application Data

(60) Provisional application No. 62/988,672, filed on Mar. 12, 2020.

(51) Int. Cl.
*F02M 9/02* (2006.01)

(52) U.S. Cl.
CPC ..... *F02M 9/026* (2013.01); *F02M 9/023* (2013.01)

(58) Field of Classification Search
CPC ..... F02M 9/026; F02M 9/023; F02D 9/107; F02D 9/108; F02D 9/101
USPC ..... 123/337
See application file for complete search history.

(56) References Cited

U.S. PATENT DOCUMENTS

| | | | | |
|---|---|---|---|---|
| 5,992,378 | A * | 11/1999 | Parkinson | F02D 9/106 29/890.12 |
| 6,354,567 | B1 * | 3/2002 | Vanderveen | F16K 27/0218 251/308 |
| 2002/0088422 | A1 * | 7/2002 | Lozen | F16K 1/222 123/184.55 |
| 2002/0104510 | A1 * | 8/2002 | Kotchi | F02D 9/108 251/305 |
| 2009/0050106 | A1 * | 2/2009 | Bessho | F02D 9/1015 123/337 |

* cited by examiner

*Primary Examiner* — Yi-Kai Wang

(57) ABSTRACT

A valve, such as a throttle valve plate, which is suitable for use with a throttle assembly, and is able to withstand a backpressure test. The throttle valve plate includes a flat plate, and a plastic material overmolded onto a portion of the valve plate. The plate includes at least one rib, and may include a plurality of ribs, allowing for a thinner and lighter weight plate which is manufactured at a lower cost. The valve may also be a two-piece valve plate having an overlap portion. The two pieces of the valve plate overlap at the portion of the valve plate which interfaces with the shaft of the throttle assembly. The remaining portion of the plate surface includes at least one ribbed feature, and may include a plurality of ribbed features which reduce material usage and therefore reduce weight and cost, but also provide the required strength and rigidity.

21 Claims, 14 Drawing Sheets

THROTTLE PLATE

CROSS-REFERENCE TO RELATED APPLICATIONS

This application claims the benefit of provisional application 62/988,672 filed Mar. 12, 2020. The disclosure of the above application is incorporated herein by reference.

FIELD OF THE INVENTION

The invention relates generally to a throttle plate which is part of a throttle assembly, where the throttle plate includes at least one feature, or deformation area, such as a rib or a plurality of ribs, and the throttle plate is made with reduced cost and weight, and is still able to be used with existing manufacturing and assembly processes.

BACKGROUND OF THE INVENTION

Throttle assemblies are generally known and are typically used to control the flow of air into an engine. Most throttle assemblies typically have a valve which is mounted to a shaft, where the shaft is rotated (by an actuator) to change the position of the valve and therefore control the flow of air into the engine. These types of valves must withstand exposure to certain pressures and temperatures. These valves also must pass a "backfire" test, where the valve is exposed to a sudden burst of pressure from the engine. In order to pass this test, the valve must have a minimum structural robustness and rigidity. The required flat plate thickness also adds inertia loading to the actuator componentry, impacting performance and durability of the throttle assembly.

Accordingly, there exists a need for a valve for a throttle assembly, that is able to withstand a backfire test, is also lightweight, and may be manufactured with minimal or no increased cost.

SUMMARY OF THE INVENTION

In one embodiment, the present invention is a valve, such as a valve plate, which is suitable for use with a throttle assembly, and is able to withstand a backfire or backpressure test. The valve plate of the present invention is also able to be used as a replacement for existing valve plates, with minimal changes to the other components of the throttle assembly, or the manufacturing processes of the throttle assembly. In an embodiment, the valve is a valve plate which includes a flat plate, and a plastic material overmolded onto the valve plate. The valve plate includes at least one rib, and in one embodiment includes a plurality of ribs, allowing for a thinner and lighter weight plate which is manufactured at a lower cost.

In an embodiment, the valve of the present invention is a two-piece valve plate having an overlap portion. In this embodiment, the two pieces of the throttle valve overlap at the portion of the valve plate which interfaces with the shaft of the throttle assembly. The remaining portion of the plate surface includes at least one ribbed feature, and in one embodiment includes a plurality of ribbed features which reduce material usage and therefore reduce weight and cost, but also provide the required strength and rigidity.

In an embodiment, the present invention is a valve plate, including a first half having at least one deformation area, a second half having at least one deformation area, a first assembly flange integrally formed as part of the first half, and a second assembly flange integrally formed as a part of the second half. The first assembly flange and the second assembly flange are in contact with one another when the first half is assembled to the second half.

In an embodiment, the deformation area of the first half is a rib. In an embodiment, the deformation area of the second half is a rib. In an embodiment, the deformation area of the first half is a plurality of ribs. In an embodiment, the deformation area of the second half is a plurality of ribs.

In an embodiment, the valve plate includes a first flange portion integrally formed as part of the first half, and the first assembly flange is integrally formed with and offset form the first flange portion. The valve plate also includes a second flange portion integrally formed as part of the second half, where the second assembly flange is integrally formed with and offset from the second flange portion.

In an embodiment, the valve plate includes a first rib integrally formed as part of the first flange portion, and a second rib integrally formed as part of the second flange portion. The combined thickness of the first flange portion and the first rib is less than the combined thickness of the first assembly flange and the second assembly flange, and the combined thickness of the second flange portion and the second rib is less than the combined thickness of the first assembly flange and the second assembly flange.

In an embodiment, at least one assembly aperture is integrally formed as part of the first assembly flange, and at least one assembly aperture is integrally formed as part of the second assembly flange. The assembly aperture integrally formed as part of the first assembly flange and the assembly aperture integrally formed as part of the second assembly flange are aligned with one another when the first half is assembled to the second half, and the first assembly flange and the second assembly flange overlap.

In an embodiment, a shaft having a slot is integrally formed as part of the shaft. The combined thickness of the first assembly flange and the second assembly flange is such that there is a sliding fit between the first assembly flange, the second assembly flange and the slot when the valve plate is assembled with the shaft.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

A first embodiment of a throttle plate or valve plate according to the present invention is shown in FIGS. 1-6 generally at 10, where the throttle plate 10 may be used as part of a throttle assembly for controlling air flow into an engine. The throttle plate 10 includes a first half 12 and a second half 14. The first half 12 of the throttle plate 10 and the second half 14 are of generally the same shape. Each half 12,14 includes an assembly flange 16*a*,16*b*. Although two assembly flanges 16*a*,16*b* are shown, it is within the scope of the invention that a single assembly flange, or a plurality of assembly flanges with corresponding assembly apertures may be used. The assembly flange 16*a* includes two assembly apertures 18*a*,18*b*, and the other assembly flange 16*b* also includes two assembly apertures 20*a*,20*b*.

The assembly flanges 16*a*,16*b* are each integrally formed with a flange portion 22*a*,22*b*, respectively, and each flange portion 22*a*,22*b* includes at least one deformation area. In this embodiment, the deformation areas are a singular rib 24*a* integrally formed as part of the flange portion 22*a* of the first half 12, and a singular rib 24*b* integrally formed as part of the flange portion 22*b* of the second half 14. Each rib 24*a*,24*b* is semi-circular in shape, but it is within the scope of the invention that other shapes may be used. The deformation areas may have shapes which are different than that of the ribs 24*a*,24*b*, any other shape may be used which has geometry which increases structural integrity compared to a flat surface.

In this embodiment, the thickness 26*a*,26*b* of the assembly flanges 16*a*,16*b* is substantially the same the thickness 28*a*,28*b* of the flange portions 22*a*,22*b* in the areas of the flange portions 22*a*,22*b* which are unoccupied by the ribs 24*a*,24*b*. It may be seen in FIGS. 4A, 4B, 5, and 6 that the assembly flanges 16*a*,16*b* are also offset from the flange portions 22*a*,22*b*. The first assembly flange 16*a* is offset from the flange portion 22*a* in the same direction the rib 24*a* protrudes from the flange portion 22*a*. Also, the second assembly flange 16*b* is offset from the flange portion 22*b* in the same direction the rib 24*b* protrudes from the flange portion 22*b*.

Figure 1:
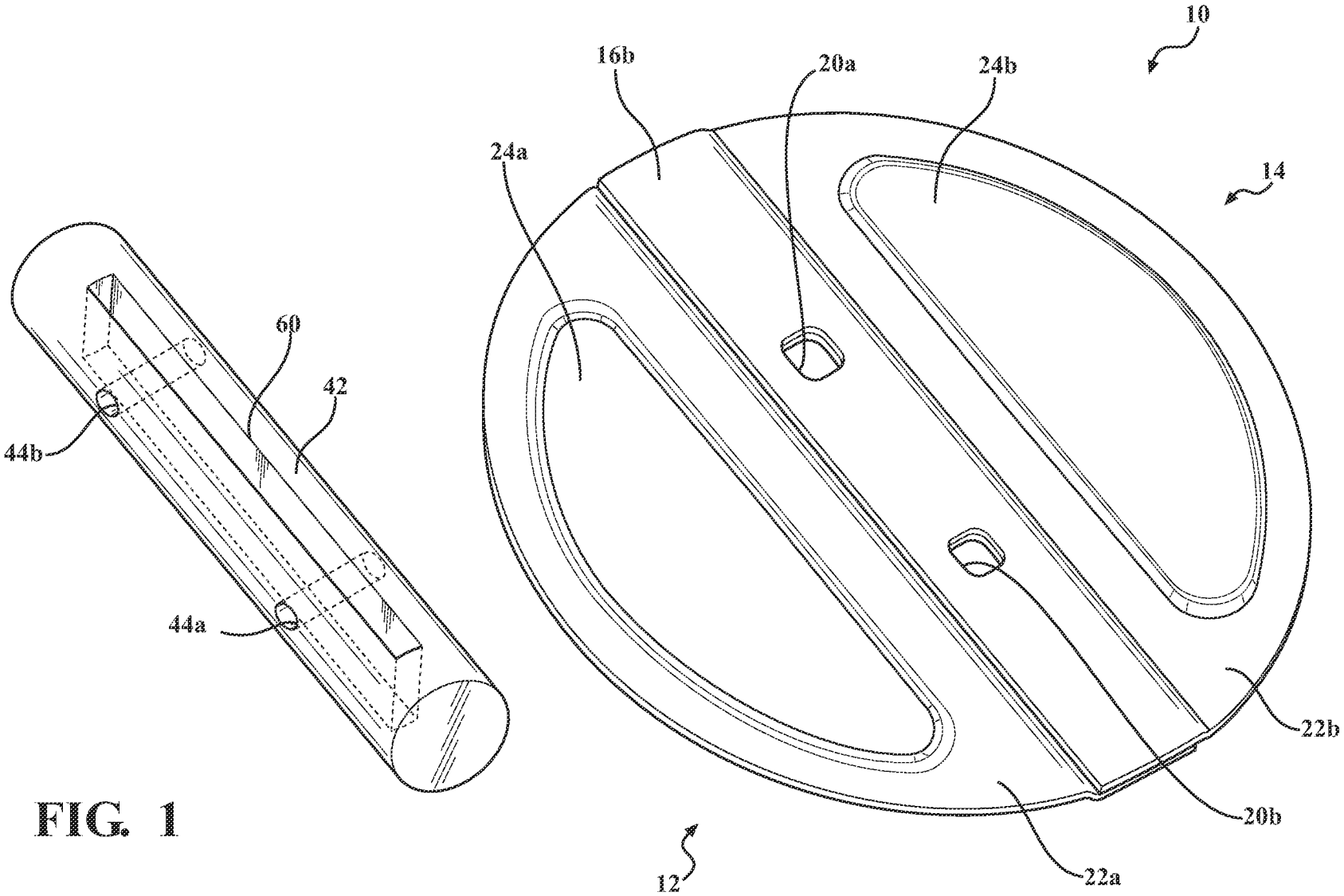
FIG. 1 is a perspective view of an embodiment of valve plate next to a shaft, according to embodiments of the present invention.
Figure 2:
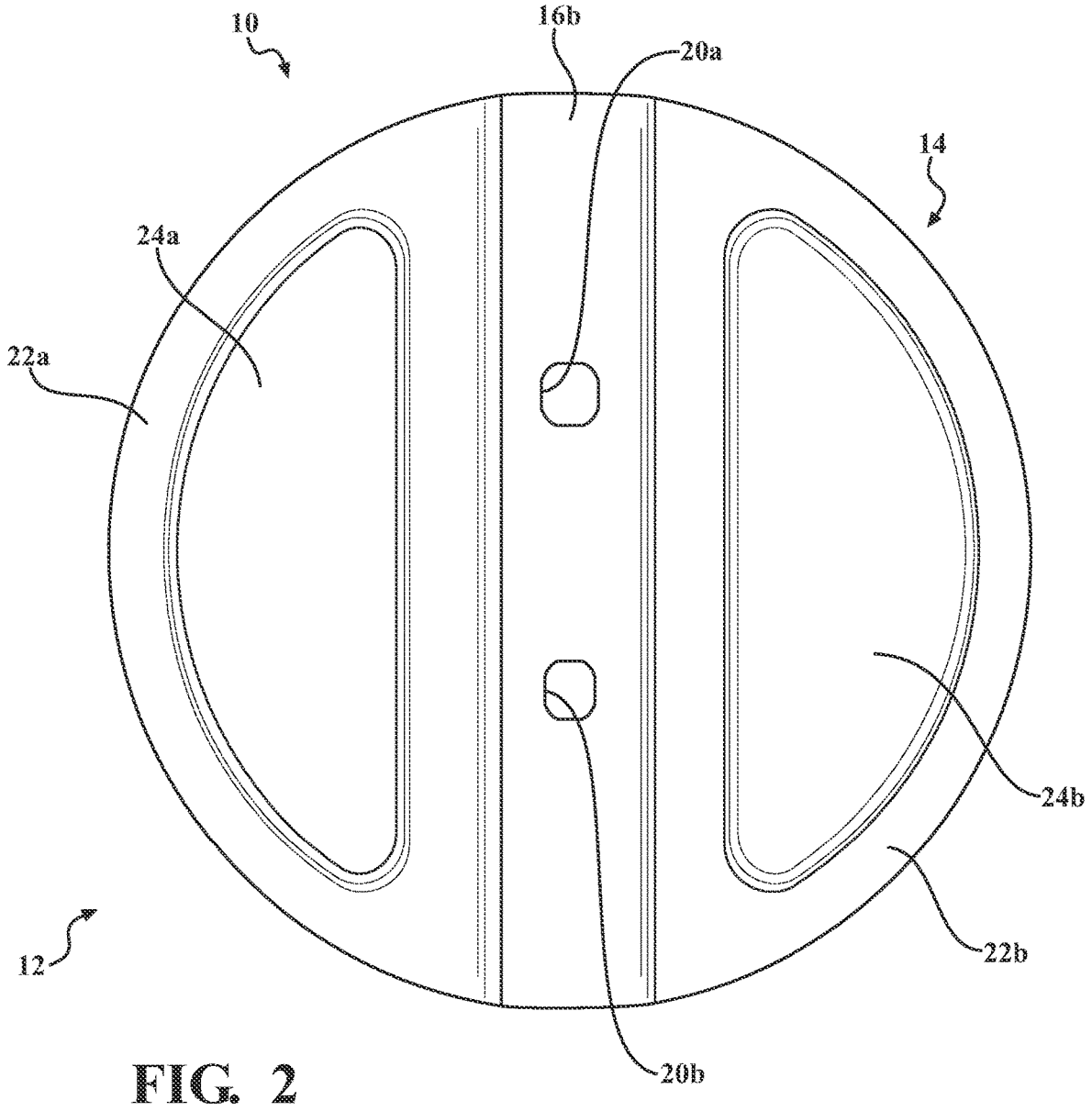
FIG. 2 is a top view of an embodiment of a valve plate, according to embodiments of the present invention.
Figure 3B:
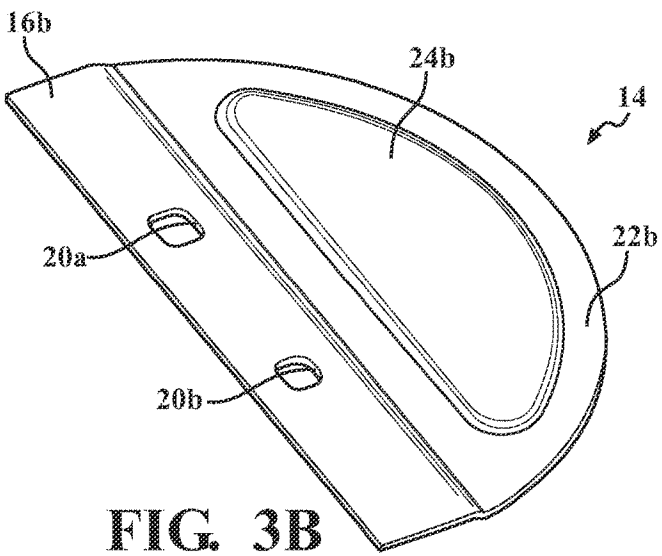
FIG. 3B is a perspective view of a second half of a valve plate, according to embodiments of the present invention.
Figure 3A:
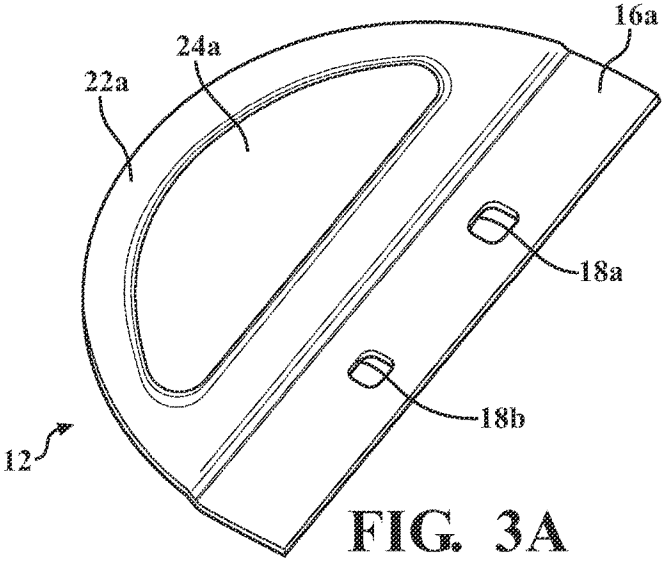
FIG. 3A is a perspective view of a first half of a valve plate, according to embodiments of the present invention.
Figure 4A:
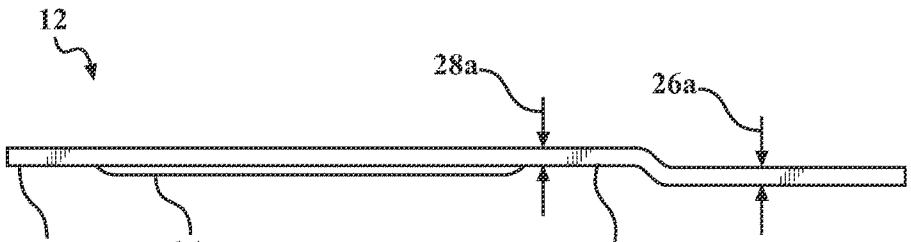
FIG. 4A is a side view of a first half of a valve plate, according to embodiments of the present invention.
Figure 4B:
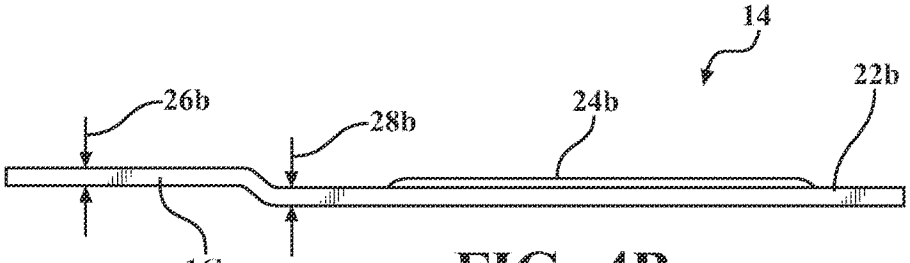
FIG. 4B is a side view of a second half of a valve plate, according to embodiments of the present invention.
Figure 5:
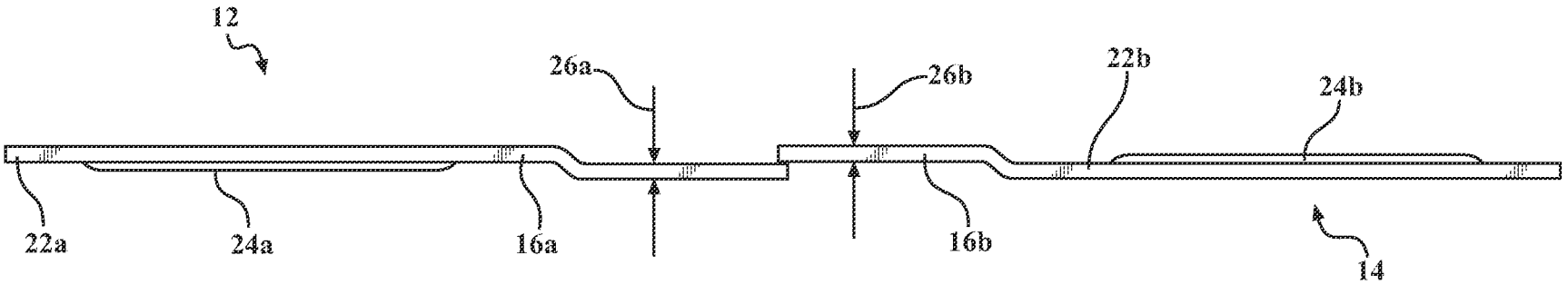
FIG. 5 is a side view of a first half and second half of valve plate during assembly, according to embodiments of the present invention.
Figure 6:
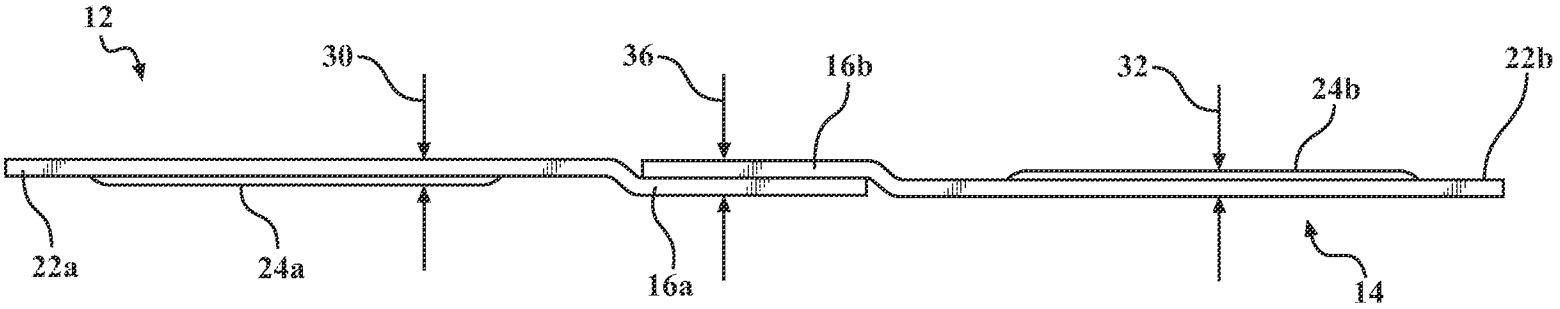
FIG. 6 is a side view of an embodiment of valve plate, according to embodiments of the present invention.

During assembly, the halves 12,14 are assembled such that the assembly flanges 16*a*,16*b* are in contact with one another, and the assembly apertures 18*a*,18*b* of the assembly flange 16*a* are in alignment with the assembly apertures 20*a*,20*b* of the assembly flange 16*b*, as shown in FIGS. 1-2 and 6. An adhesive is used to attach the first assembly flange 16*a* to the second assembly flange 16*b*. Different types of adhesives could be used, and various bonding processes could be used to attach the first assembly flange 16*a* to the second assembly flange 16*b*. During assembly, the plate 10 is inserted into a slot 60 of a shaft 42 such that the apertures 18*a*,18*b*,20*a*,20*b* are aligned with assembly apertures 44*a*, 44*b* formed as part of the shaft 42, and fasteners (not shown) are inserted through the apertures 18*a*,18*b*,20*a*,20*b* and assembly apertures 44*a*,44*b* formed as part of the shaft 42, to attach the plate 10 to the shaft 42. Furthermore, the assembly flanges 16*a*,16*b* are offset from the flange portions 22*a*,22*b* such that when the halves 12,14 are assembled to one another, the assembly flange 16*a* of the first half 12 is in general alignment with the flange portion 22*b* of the second half 14, and the assembly flange 16*b* of the second half 14 is in general alignment with the flange portion 22*a* of the first half 12. Also, when the halves 12,14 are assembled, the ribs 24*a*,24*b* are on opposite sides of the throttle plate 10 relative to one another.

Referring now to FIG. 6, when the halves 12,14 are assembled, the combined overall thickness 30 of the rib 24*a* and the flange portion 22*a* is less than the combined thickness 36 of the assembly flanges 16*a*,16*b*. Additionally, the combined overall thickness 32 of the rib 24*b* and the flange portion 22*b* is also less than the combined thickness 36 of the assembly flanges 16*a*,16*b*.

Also, the combined thickness 36 of the assembly flanges 16*a*,16*b* results in the throttle plate 10 fitting into a slot 60 of the shaft 42 such that air leaking through the slot 60 is prevented or at least minimized. Furthermore, the width of the slot 60 and the thickness 36 of the assembly flanges 16*a*,16*b* correspond to a width and thickness that provides a sliding fit between the throttle plate 10 and the slot 60, such that during assembly the throttle plate 10 may be assembled to the shaft 42 by sliding the throttle plate 10 into the slot 60. Once the throttle plate 10 is assembled to the shaft 42, there is minimal clearance between the throttle plate 10 and the slot 60 to minimize air flow leakage through the slot 60. In an embodiment, the sliding fit is such that the throttle plate 10 is able to slide into the slot 60 using a gravity feed. The combined thickness 36 of the assembly flanges 16*a*,16*b* also allows for the throttle plate 10 to be used with the shaft 42 and slot 60 without having to change the dimensions of the slot 60, where the shaft 42 is used with existing throttle plate designs. In alternate embodiments, the dimensions of the slot 60 may be altered (within the design limits of the shaft 42) as well as the dimensions of the assembly flanges 16*a*,16*b*, which changes the corresponding thickness 36, to achieve the desired sliding fit.

Figure 7:
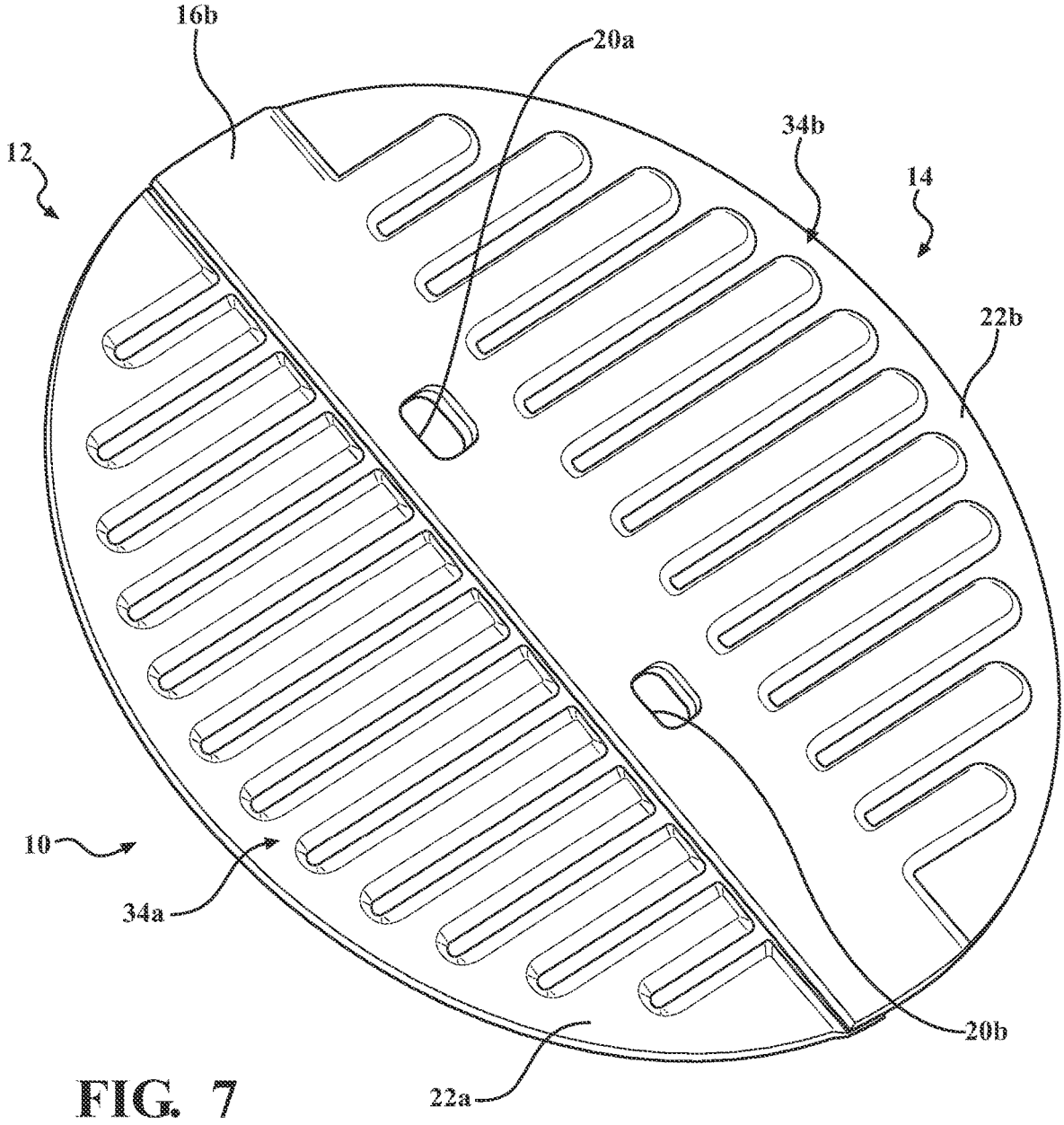
FIG. 7 is a perspective view of an alternate embodiment of valve plate, according to embodiments of the present invention.

An alternate embodiment of the throttle plate is shown in FIG. 7, with like numbers referring to like elements. In this embodiment, instead of there being a singular rib, there is a first plurality of ribs, shown generally at 34*a*, integrally formed as part of the flange portion 22*a* of the first half 12, and a second plurality of ribs 34*b* integrally formed as part of the flange portion 22*b* of the second half 14.

Figure 8:
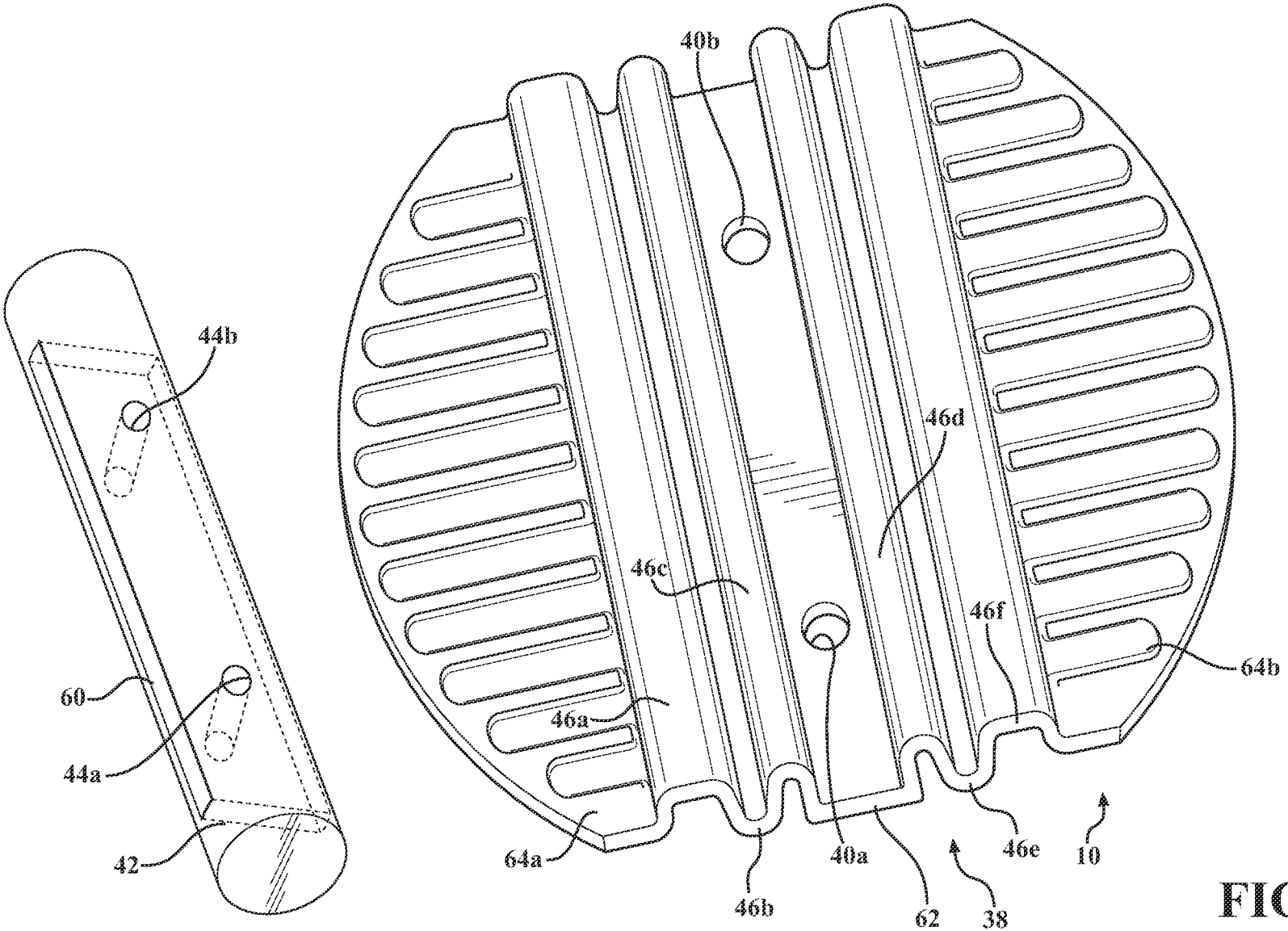
FIG. 8 is a perspective view of another alternate embodiment of a valve plate next to a shaft, according to embodiments of the present invention.
Figure 9A:
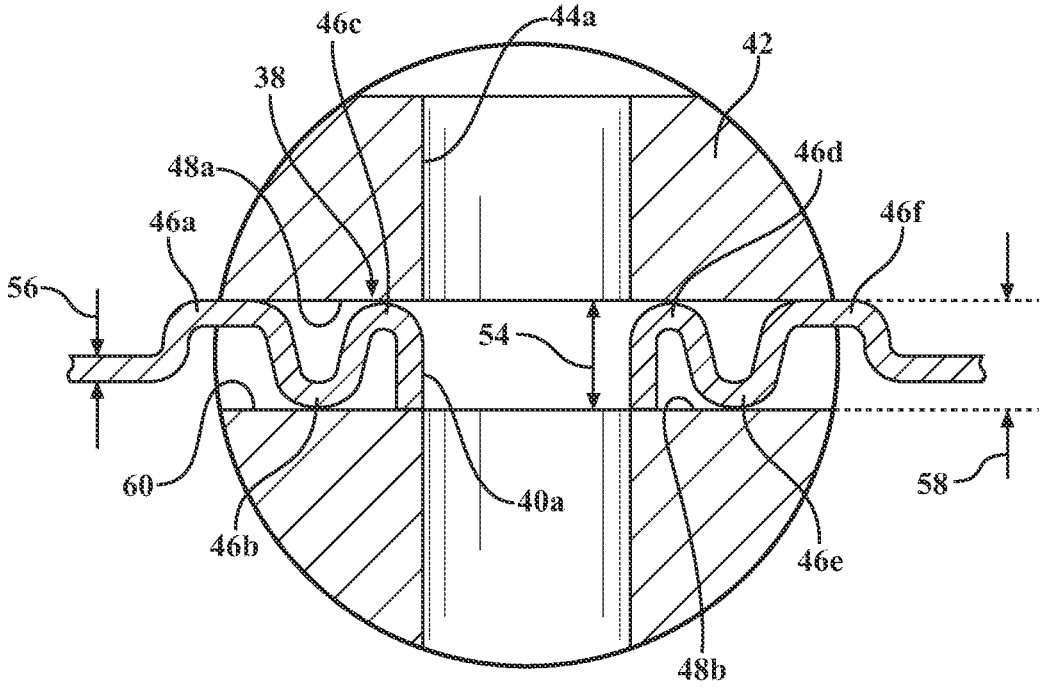
FIG. 9A is a first sectional side view of another alternate embodiment of a valve plate, according to embodiments of the present invention.
Figure 9B:
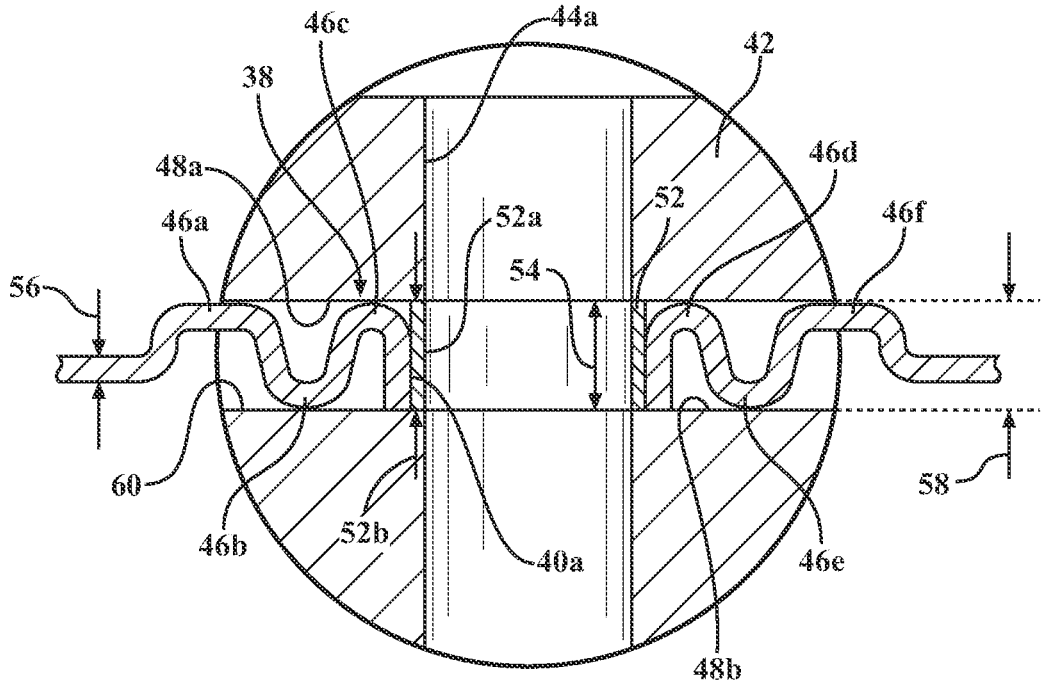
FIG. 9B is a second sectional side view of another alternate embodiment of a valve plate, according to embodiments of the present invention.

Another embodiment of the invention is shown in FIGS. 8 and 9A-9B. In this embodiment, the throttle plate 10 is a single piece throttle plate, and the throttle plate 10 includes a deformation area, shown generally at 38. Integrally formed as part of the deformation area 38 is two assembly apertures 40*a*,40*b*. When assembled, the throttle plate 10 is connected to the shaft 42, and integrally formed as part of the shaft 42 is the slot 60. The throttle plate 10 is inserted into the slot 60 during assembly, such that the assembly apertures 40*a*,40*b* are aligned with the other assembly apertures 44*a*,44*b* formed as part of the shaft 42. Two fasteners extend through the apertures 40*a*,40*b*,44*a*,44*b* to secure the throttle plate 10 to the shaft 42. In one embodiment, the deformation area 38 includes at least one rib portion, and in this embodiment, includes several rib portions 46*a*,46*b*,46*c*,46*d*,46*e*,46*f* integrally formed as part of the throttle plate 10, and several of the rib portions 46*a*,46*b*,46*c*,46*d*,46*e*,46*f* are in contact with the inner walls 48*a*,48*b* of the slot 60, as shown in FIGS. 9A and 9B, to provide a sliding fit between the throttle plate 10 and the shaft 42, more specifically the slot 60, in a similar manner to the previous embodiment. In the embodiment shown in FIGS. 8 and 9A-9B, once the throttle plate 10 is assembled to the shaft 42, there is minimal clearance between the throttle plate 10 and the slot 60 to minimize air flow leakage through the slot 60. More specifically, the sliding fit between the rib portions 46*a*,46*b*,46*c*,46*d*,46*e*,46*f* and the inner walls 48*a*,48*b* is such that air flow leakage through the slot 60 is minimized. In an embodiment, the throttle plate 10 is able to slide into the slot 60 using a gravity feed. More specifically, the first rib portion 46*a*, third rib portion 46*c*, fourth rib portion 46*d*, and the sixth rib portion 46*f* have a minimal clearance relative to the first inner wall 48*a*, and the second rib portion 46*b* and the fifth rib portion 46*e* have a minimal clearance relative to the second inner wall 48*b*. The first rib portion 46*a* is integrally formed with a first outer flange portion 64*a* of the throttle plate 10. The second rib portion 46*b* is integrally formed with the first rib portion 46*a*, and the third rib portion 46*c* is integrally formed with the second rib portion 46*b*. The fourth rib portion 46*d* is integrally formed with the fifth rib portion 46*e*, and the fifth rib portion 46*e* is integrally formed with the sixth rib portion 46*f*. The sixth rib portion 46*f* is integrally formed with a second outer flange portion 64*b* of the throttle plate 10. The rib portions 46*a*,46*b*,46*c*,46*d*,46*e*,46*f* are integrally formed with one another and arranged such that the rib portions 46*a*,46*b*,46*c*,46*d*,46*e*,46*f* protrude towards the inner walls 48*a*,48*b* in alternating fashion. The rib portions 46*a*,46*c*,46*d*,46*f* protrude towards the inner wall 48*a*, and the rib portions 46*b*,46*d* protrude towards the inner wall 48*b*.

Also formed as part of the plate 10 is a central flange portion 62, which is located between and integrally formed with the rib portion 46*c* and the rib portion 46*d*, where the central flange portion 62 is in contact with the inner wall 48*b* when the throttle plate 10 is connected to the shaft 42. The assembly apertures 40*a*,40*b* are integrally formed as part of the central flange portion 62. In one embodiment, a support structure (not shown) made of plastic overmold material and located on the central flange portion 62, may also be used as well to provide the sliding fit between the plate 10 and the slot 60. In one embodiment, support rings, or stand offs 52, only one of which is shown in FIG. 9B, are used to provide support and increase robustness to manage the clamping load from the fasteners on the throttle plate 10. The stand offs 52 are inserted into the assembly apertures 40*a*,40*b* of the central flange portion 62. The stand off 52 is shown inserted into the assembly aperture 40*a* of the central flange portion 62 in FIG. 9B. The thickness 52*b* of the stand offs 52 is approximately equal to an overall width 58 of the rib portions 46*a*,46*b*,46*c*,46*d*,46*e*,46*f*.

Next, the throttle plate 10 is inserted into the slot 60 during assembly, such that the assembly apertures 40*a*,40*b* of the central flange portion 62 are aligned with assembly apertures 44*a*,44*b* formed as part of the shaft 42. Apertures 52*a* formed as part of the stand offs 52 are also aligned with the assembly apertures 44*a*,44*b* formed as part of the shaft 42. Two fasteners extend through apertures 52*a* formed as part of the stand offs 52 and the assembly apertures 44*a*,44*b* formed as part of the shaft 42 to secure the throttle plate 10 to the shaft 42. This results in a clamping force applied to the stand offs 52.

Again, the width 54 of the slot 60 in this embodiment is approximately 2 mm. However, the thickness 56 of the throttle plate 10 may be less than 2 mm, and the rib portions 46*a*,46*b*,46*c*,46*d*,46*e*,46*f* may be configured such that the overall width 58 of the rib portions 46*a*,46*b*,46*c*,46*d*,46*e*,46*f* corresponds to a width that provides the sliding fit between the throttle plate 10 and the slot 60.

Another embodiment of the throttle plate 10 is shown in FIGS. 10-13, with like numbers referring to like elements. In this embodiment, the throttle plate 10 is a single piece, has a first outer flange portion, shown generally at 66*a*, and a second outer flange portion, shown generally at 66*b*. Each of the outer flange portions 66*a*,66*b* are integrally formed with a central flange portion 68, and integrally formed as part of the central flange portion 68 are two assembly apertures 70*a*,70*b*.

Figure 12A:
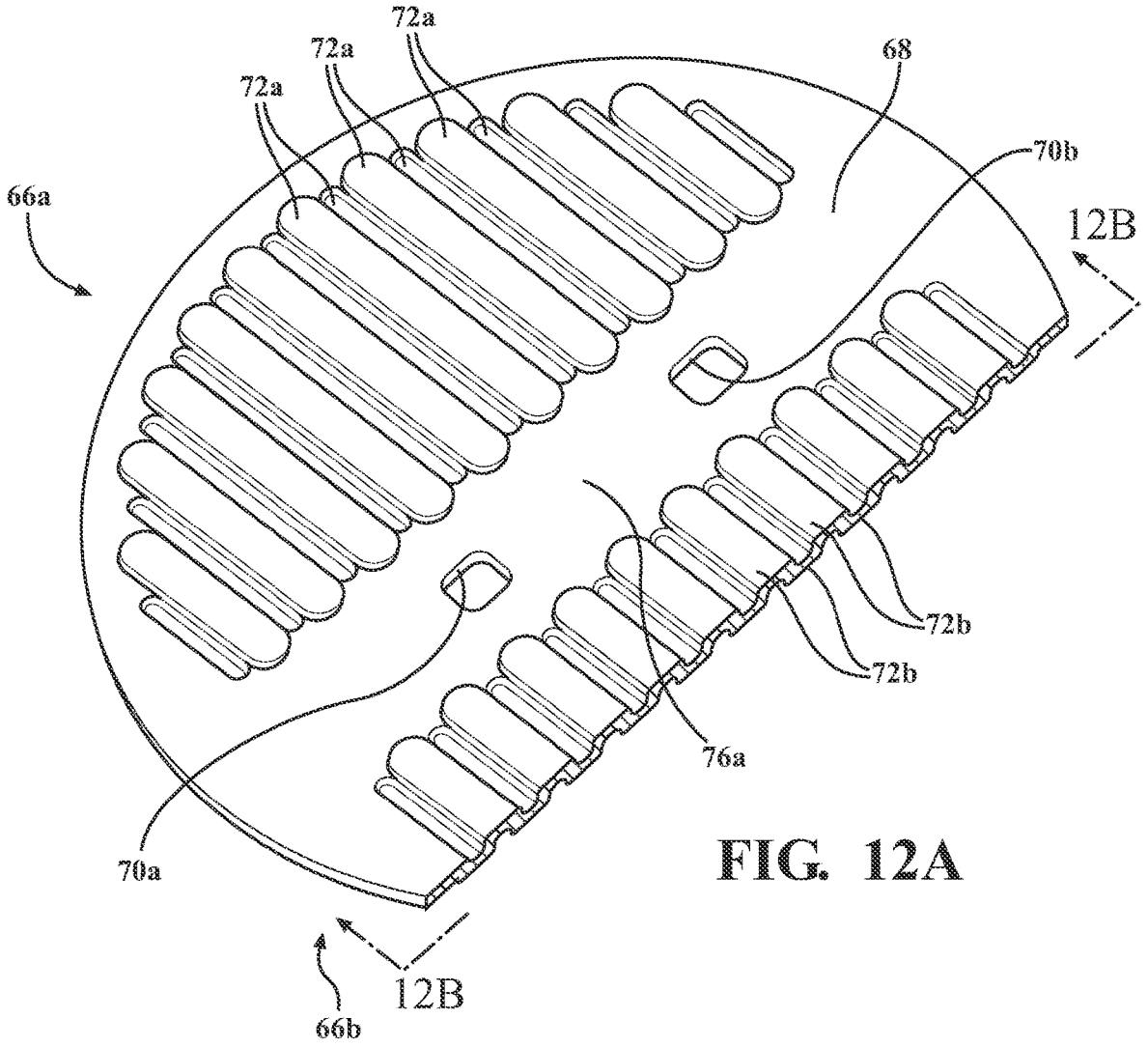
FIG. 12A is a perspective view of the valve plate in FIG. 11 with a section removed, according to embodiments of the present invention.
Figure 12B:
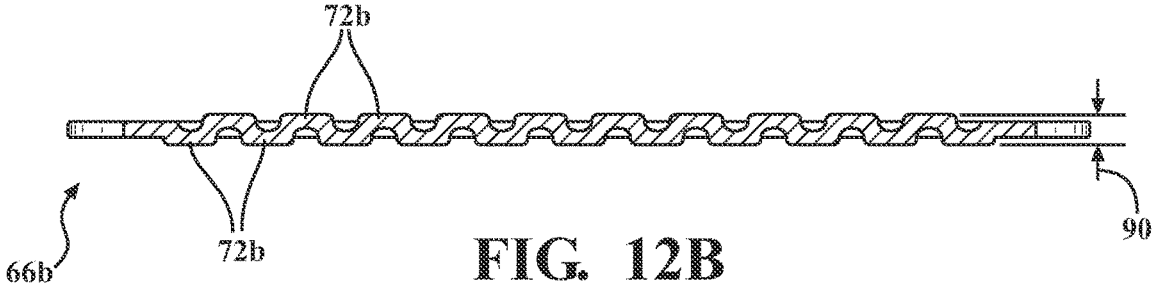
FIG. 12B is sectional view taken along lines 12B-12B shown in FIG. 12A.
Figure 12C:
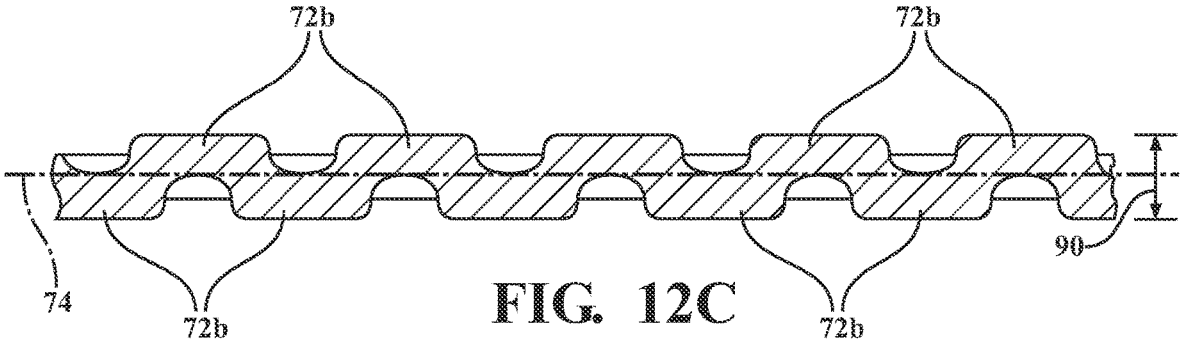
FIG. 12C is an enlarged sectional view of the portion of the valve plate shown in FIG. 12B.
Figure 12D:
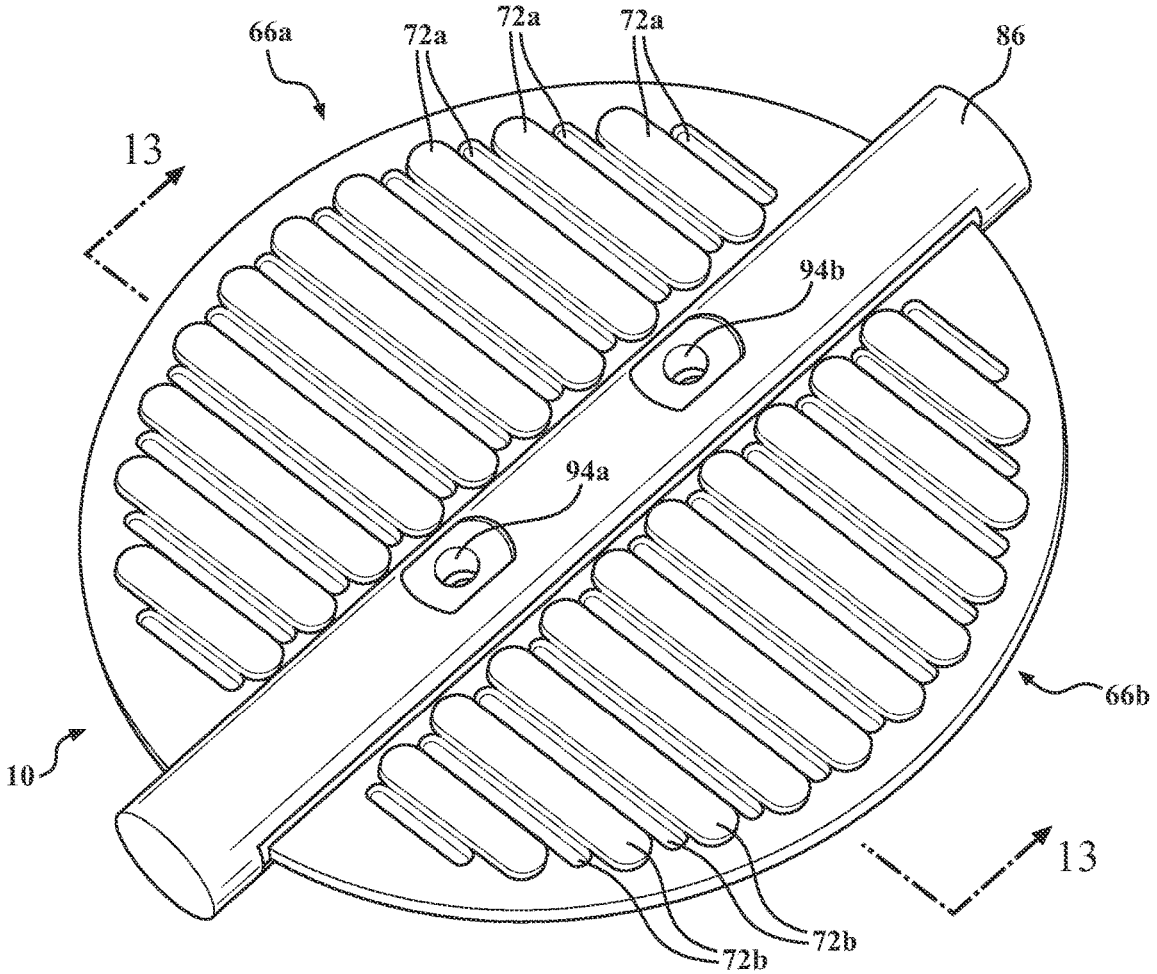
FIG. 12D is a is a perspective view of the valve plate in FIG. 10 mounted to a shaft, according to embodiments of the present invention.

Integrally formed as part of the first outer flange portion 66*a* is a first plurality of ribs 72*a*, and integrally formed as part of the second outer flange portion 66*b* is a second plurality of ribs 72*b*. Each of the pluralities of ribs 72*a*,72*b* protrude away from a central axis 74 in alternating fashion, as shown in FIGS. 12A, 12B, and 12C.

Figure 10:
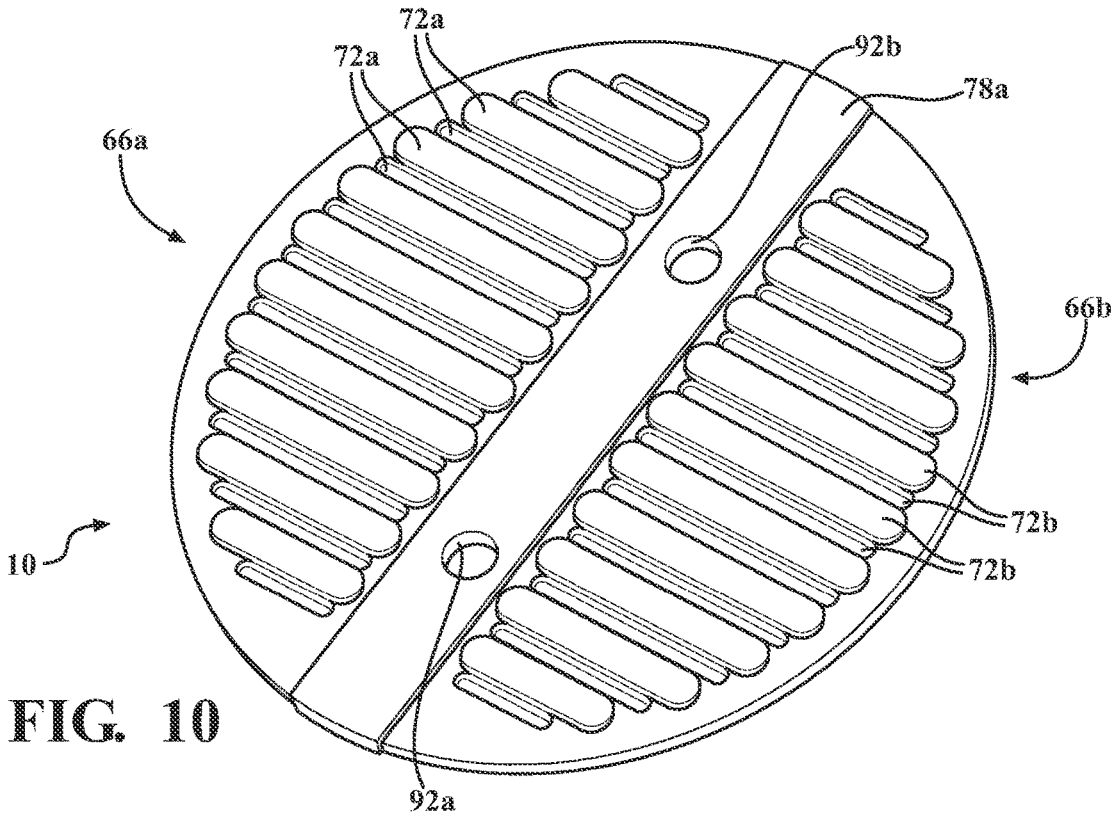
FIG. 10 is a perspective view of yet another alternate embodiment of a valve plate, according to embodiments of the present invention.
Figure 11:
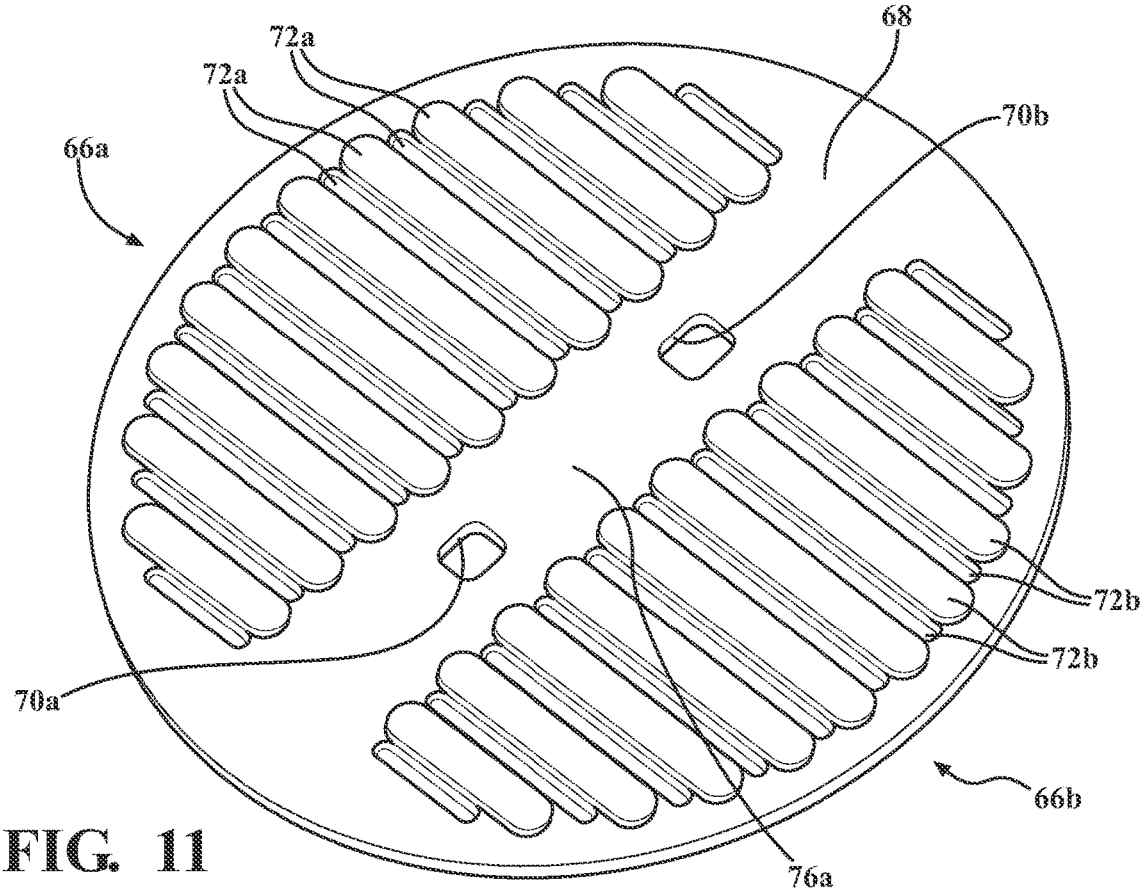
FIG. 11 is a perspective view of the valve plate in FIG. 10 with the overmold material removed, according to embodiments of the present invention.
Figure 13:
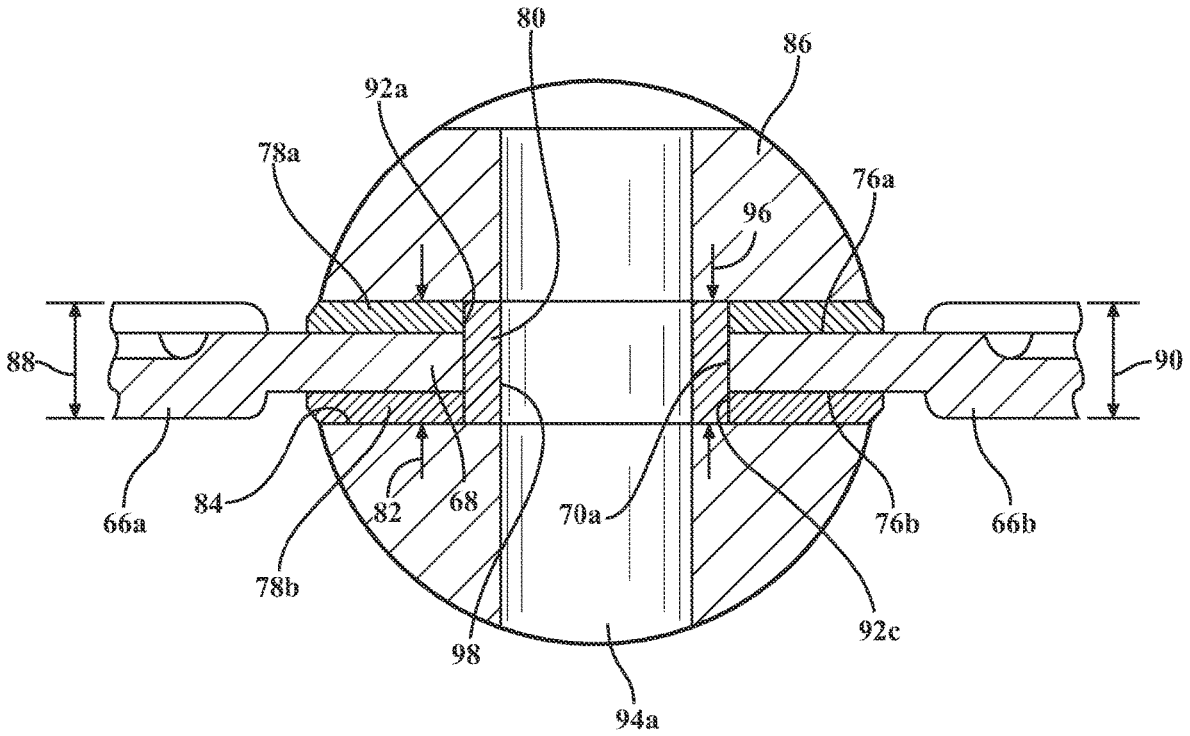
FIG. 13 is a sectional view taken along lines 13-13 shown in FIG. 12D.
Figure 14:
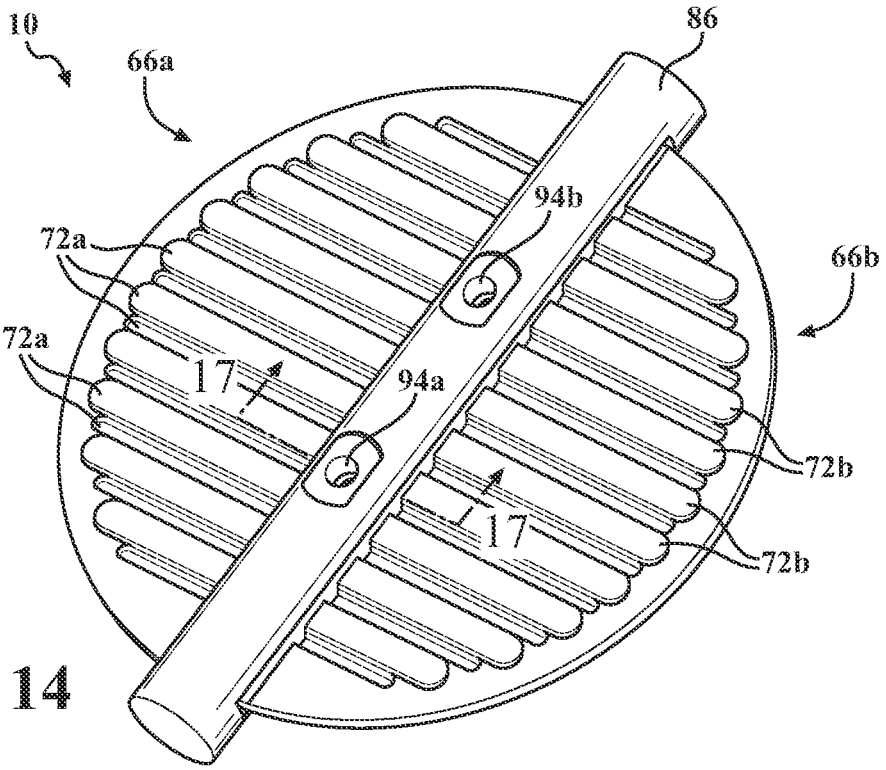
FIG. 14 is a perspective view of another alternate embodiment of a valve plate mounted to a shaft, according to embodiments of the present invention.
Figure 15:
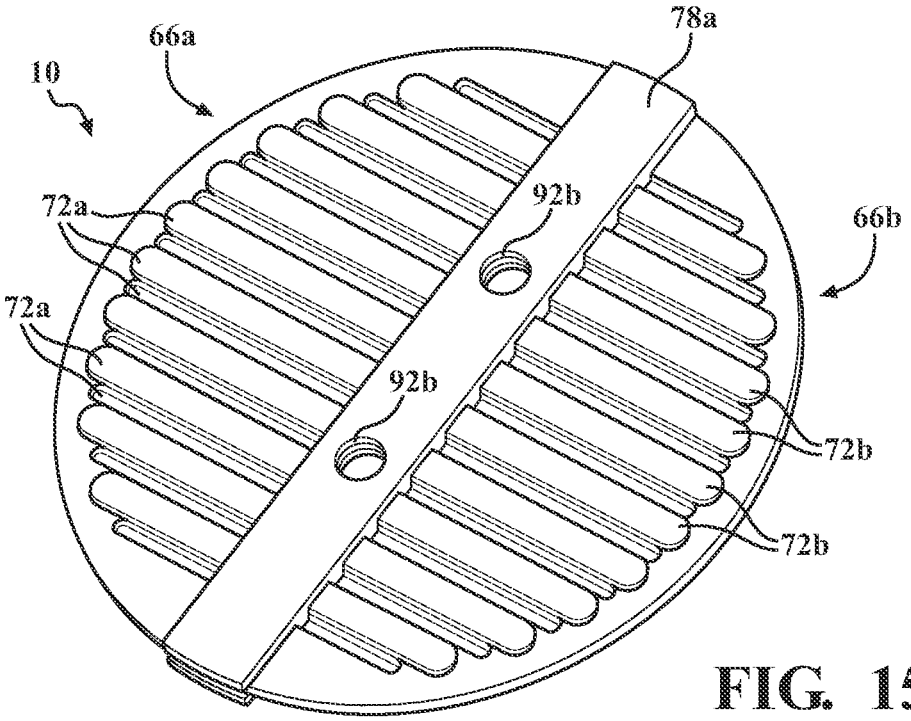
FIG. 15 is a perspective view of the valve plate shown in FIG. 14, removed from the shaft, according to embodiments of the present invention.

Referring again to FIGS. 10 and 13, attached to a first outer surface 76*a* of the throttle plate 10 is a first support structure 78*a*, and attached to a second outer surface 76*b* of the throttle plate 10 is a second support structure 78*b*. The outer surfaces 76*a*,76*b* are part of the central flange portion 68. The support structures 78*a*,78*b* are made of a plastic material, and are overmolded onto the respective surfaces 76*a*,76*b*. In this embodiment, the support structures 78*a*,78*b* extend the entire diameter of the throttle plate 10, as shown in FIG. 10, but it is within the scope of the invention that the support structures 78*a*,78*b* may have other dimensions as well. This embodiment also includes two support rings, or stand offs 80, only one of which is shown in FIG. 13, which provide support and increases robustness to manage the clamping load from the fasteners on the throttle plate 10.

The combined thickness 82 of the support structures 78*a*,78*b* and the central flange portion 68 results in the throttle plate 10 fitting into a slot 84 of a shaft 86 such that air leaking through the slot 84 is prevented or at least minimized. Furthermore, the width of the slot 84 and the combined thickness 82 of the support structures 78*a*,78*b* and the central flange portion 68 corresponds to dimensions that provide a sliding fit between the throttle plate 10 and the slot 84. Once the throttle plate 10 is assembled to the shaft 86, there is minimal clearance between the throttle plate 10 and the slot 84 to minimize air flow leakage through the slot 84. More specifically, the sliding fit between the support structures 78*a*,78*b* and slot 84 is such that air flow leakage through the slot is minimized. In an embodiment, the throttle plate 10 is able to slide into the slot 84 using a gravity feed. This minimizes air flow through the slot 84. The combined thickness 82 of the support structures 78*a*,78*b* and the central flange portion 68 also allows for the throttle plate 10 to be used with the shaft 86 and slot 84 without having to change the dimensions of the slot 84 where the shaft 86 is used with existing throttle plate designs.

The combined overall thickness 88 of the ribs 72*a* formed as part of the first outer flange portion 66*a* is less than the combined thickness 82 of the support structures 78*a*,78*b* and the central flange portion 68. Additionally, the combined overall thickness 90 of the ribs 72*b* formed as part of the second outer flange portion 66*b* is also less than the combined thickness 82 of the support structures 78*a*,78*b* and the central flange portion 68.

There are assembly apertures 92*a*,92*b* integrally formed as part of the first support structure 78*a*, which are respectively aligned with the assembly apertures 70*a*,70*b* formed as part of the central flange portion 68. There are also two assembly apertures (one assembly aperture 92*c* is shown in FIG. 13) integrally formed as part of the second support structure 78*b*, which are also respectively aligned with the assembly apertures 70*a*,70*b* formed as part of the central flange portion 68. The assembly apertures 70*a*,70*b* of the central flange portion 68 and the and the assembly apertures 92*a*,92*b*,92*c* integrally formed as part of the support structures 78*a*,78*b* have approximately the same inner diameter such that during assembly, the stand offs 80 are inserted into the assembly apertures 70*a*,70*b* of the central flange portion 68 and the and the assembly apertures 92*a*,92*b*,92*c* integrally formed as part of the support structures 78*a*,78*b*. The stand off 80 is shown inserted into the assembly apertures 70*a* of the central flange portion 68 and the assembly apertures 92*a*,92*c* in FIG. 13. The thickness 96 of the stand offs 80 is approximately equal to the combined thickness 82 of the support structures 78*a*,78*b* and the central flange portion 68.

Next, the throttle plate 10 is inserted into the slot 84 during assembly, such that the assembly apertures 70*a*,70*b* of the central flange portion 68 and the and the assembly apertures 92*a*,92*b*,92*c* integrally formed as part of the support structures 78*a*,78*b* are aligned with assembly apertures 94*a*,94*b* formed as part of the shaft 86. Apertures 98 formed as part of the stand offs 80 are also aligned with the assembly apertures 94*a*,94*b* formed as part of the shaft 86. Two fasteners extend through apertures 98 formed as part of the stand offs 80 and the assembly apertures 94*a*,94*b* formed as part of the shaft 86 to secure the throttle plate 10 to the shaft 86.

Figure 16:
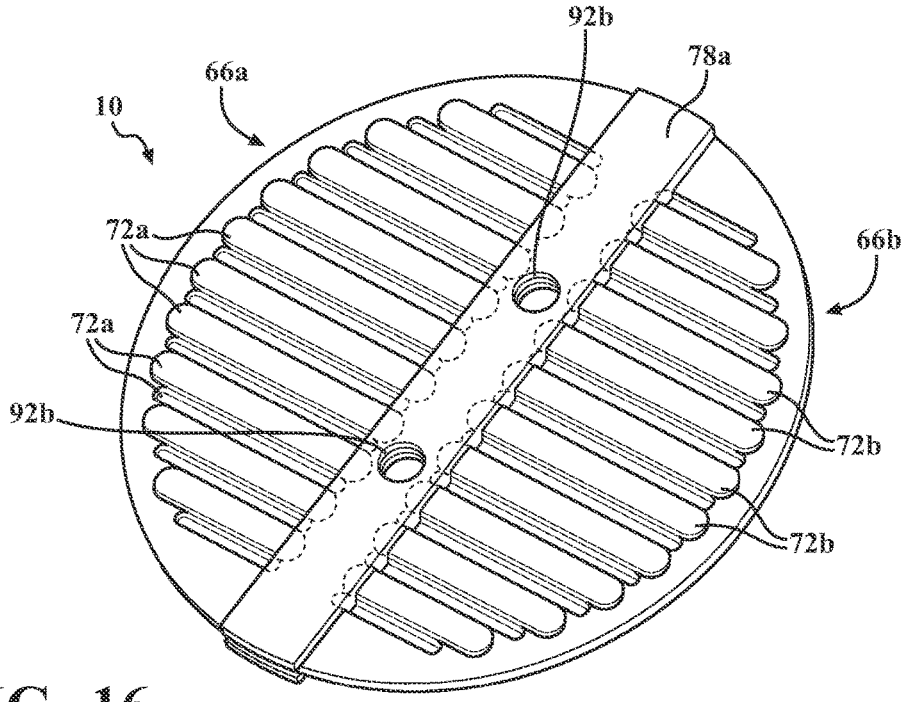
FIG. 16 is a perspective view of the valve plate shown in FIG. 15, with portions of the ribs shown in phantom and covered by one of the support structures, according to embodiments of the present invention
Figure 17:
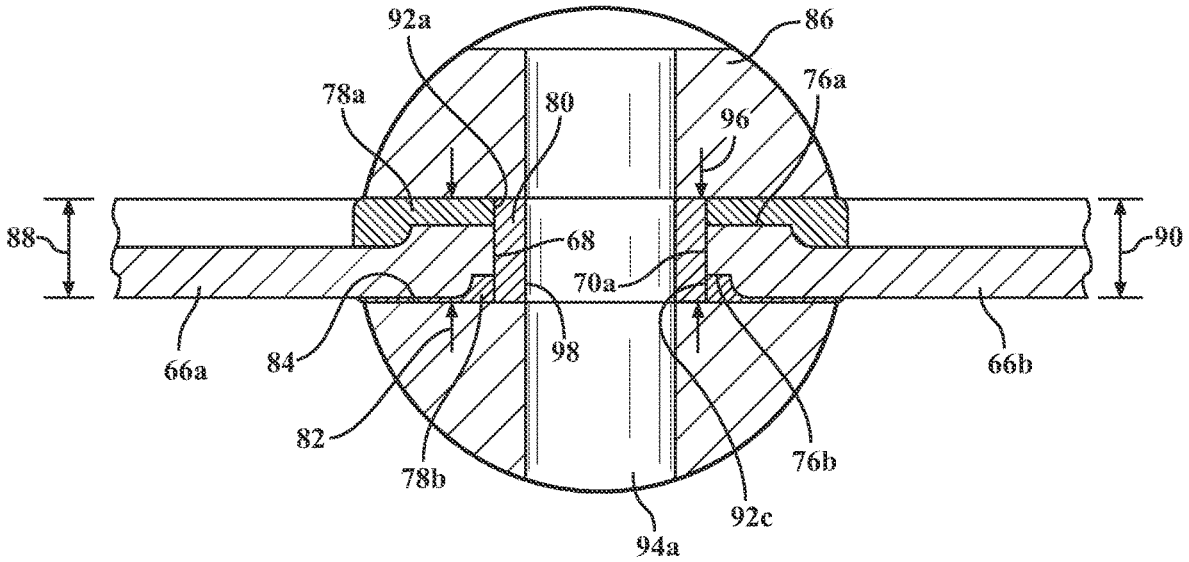
FIG. 17 is a sectional view taken along lines 17-17 shown in FIG. 14.

Another embodiment of the present invention is shown in FIGS. 14-17, with like numbers referring to like elements. In this embodiment, it is shown in FIGS. 16 and 17 that the first plurality of ribs 72*a* and the second plurality of ribs 72*b* are longer, such that the central flange portion 68 has a reduced area compared to the embodiment in shown FIGS. 10-13, and the first plurality of ribs 72*a* and the second plurality of ribs 72*b* extend into the slot 84. This results in a portion of the first plurality of ribs 72*a* and the second plurality of ribs 72*b* being covered by the support structures 78*a*,78*b*. Parts of the first plurality of ribs 72*a* and the second plurality of ribs 72*b* are shown in phantom in FIG. 16 being covered by the support structure 78*a*.

In this embodiment, as shown in FIG. 17, the combined overall thickness 88 of the ribs 72*a* formed as part of the first outer flange portion 66*a* is approximately the same the combined thickness 82 of the support structures 78*a*,78*b* and the central flange portion 68. Additionally, also shown in FIG. 17, the combined overall thickness 90 of the ribs 72*b* formed as part of the second outer flange portion 66*b* is approximately the same as the combined thickness 82 of the support structures 78*a*,78*b* and the central flange portion 68.

Figure 18:
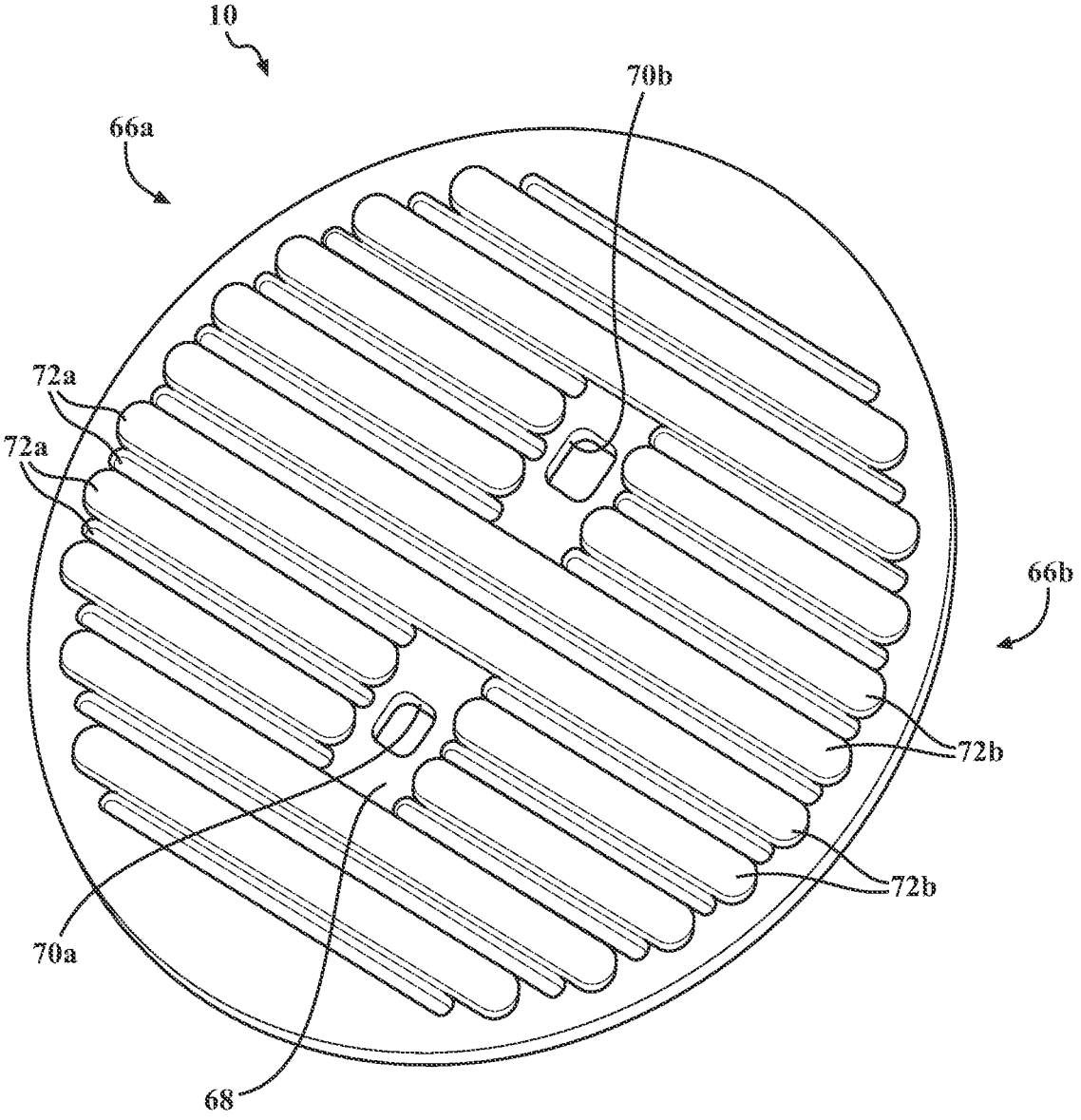
FIG. 18 is another alternate embodiment of a valve plate having ribs which extend through a slot of a shaft when the valve plate is assembled to the shaft, according to embodiments of the present invention.

In yet another embodiment, shown in FIG. 18, several of the ribs 72*a*,72*b* extend almost the entire diameter of the throttle plate 10, such that each of the plurality of ribs extends through the slot 84, providing increased robustness and rigidity of the throttle plate 10. In this embodiment, portions of the ribs 72*a*,72*b* are covered by the support structures 78*a*,78*b* (not shown).

In all embodiments, the shape of the throttle plate 10 allows for less material to be used when manufacturing the throttle plate 10, and the throttle plate 10 may be used with various existing shafts having existing slot dimensions, such that no modifications, or low cost modifications, to the existing shaft, or manufacturing processes of the throttle assembly are necessary. The throttle plate 10 may also be used with existing fixtures and grippers with only minor modifications as part of an existing manufacturing process, such as a high-volume automation assembly line, without making any significant changes to the existing manufacturing process.

The throttle plate 10 is also able to withstand exposure to various pressures and temperatures, and has the structural rigidity to pass a backfire test. Because minimal additional material is added to the throttle plate 10, there is reduced inertia loading to the actuator componentry, improving durability of actuator componentry due to lower inertia loading.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An apparatus, comprising:

a valve plate, including:

a first half having at least one deformation area;

a second half having at least one deformation area;

a first assembly flange integrally formed as part of the first half;

a first flange portion integrally formed as part of the first half, the first assembly flange integrally formed with and offset from the first flange portion;

a second assembly flange integrally formed as a part of the second half; and a second flange portion integrally formed as part of the second half, the second assembly flange integrally formed with and offset from the second flange portion;

wherein the first assembly flange and the second assembly flange are in contact with one another when the first half is assembled to the second half, the first flange portion is located adjacent to a shaft, and the second flange portion is also located adjacent to the shaft such that the second flange portion is on the opposite side of the shaft as the first flange portion.

2. The apparatus of claim 1, the at least one deformation area of the first half further comprising a rib.

3. The apparatus of claim 1, the at least one deformation area of the second half further comprising a rib.

4. The apparatus of claim 1, the at least one deformation area of the first half further comprising a plurality of ribs.

5. The apparatus of claim 1, the at least one deformation area of the second half further comprising a plurality of ribs.

6. The apparatus of claim 1, further comprising:

a first rib integrally formed as part of the first flange portion; and a second rib integrally formed as part of the second flange portion;

wherein the combined thickness of the first flange portion and the first rib is less than the combined thickness of the first assembly flange and the second assembly flange, and the combined thickness of the second flange portion and the second rib is less than the combined thickness of the first assembly flange and the second assembly flange.

7. The apparatus of claim 1, further comprising:

at least one assembly aperture integrally formed as part of the first assembly flange; and at least one assembly aperture integrally formed as part of the second assembly flange;

wherein the at least one assembly aperture integrally formed as part of the first assembly flange and the at least one assembly aperture integrally formed as part of the second assembly flange are aligned with one another when the first half is assembled to the second half, and the first assembly flange and the second assembly flange overlap.

8. The apparatus of claim 1, further comprising:

a slot integrally formed as part of the shaft;

wherein the combined thickness of the first assembly flange and the second assembly flange is such that there is sliding fit between the first assembly flange, the second assembly flange and the slot when the valve plate is assembled with the shaft.

9. A valve plate, comprising:

at least one deformation area further comprising:

a plurality of rib portions;

a first outer flange portion integrally formed with one of the plurality of rib portions; and a second outer flange portion integrally formed with another of the plurality of rib portions, the first outer flange portion is located on the opposite side of the shaft as the second outer flange portion;

wherein the valve plate is connected to a shaft such that at least a portion of the at least one deformation area extends through a slot integrally formed as part of the shaft.

10. The valve plate of claim 9, further comprising:

a sliding fit, wherein the shape of the at least one deformation area is such that at least a portion of the deformation area contacts at least one inner surface of the slot, achieving the sliding fit between the valve plate and the shaft.

11. The valve plate of claim 10, wherein a portion of the valve plate is located in the slot such that the at least one deformation area provides a minimal clearance between the valve plate and the slot to minimize air leakage.

12. The valve plate of claim 9, further comprising:

a central flange portion integrally formed between two of the plurality of rib portions; and at least one assembly aperture integrally formed as part of the central flange portion;

wherein a fastener at least partially extends through the at least one assembly aperture to connect the valve plate to the shaft.

13. The valve plate of claim 12, further comprising:

a stand off disposed in the at least one assembly aperture;

wherein the fastener extends through the at least one stand off, such that the fastener applies clamping force to the stand off and the fastener applies clamping force to the valve plate when the valve plate is connected to the shaft.

14. The valve plate of claim 9, wherein the plurality of rib portions protrude in alternating fashion.

15. A valve plate, comprising:

a central flange portion;

a first outer flange portion integrally formed with the central flange portion;

a second outer flange portion integrally formed with the central flange portion;

at least one deformation area integrally formed as part of either of the first outer flange portion or the second outer flange portion; and at least one support structure connected to the central flange portion;

wherein the central flange portion is attached to a shaft, such that the at least one support structure and the central flange portion are located in a slot of the shaft, and at least a portion of the at least one deformation area extends into the slot.

16. The valve plate of claim 15, the at least one deformation area further comprising:

a first plurality of ribs integrally formed as part of the first outer flange portion; and a second plurality of ribs integrally formed as part of the second outer flange portion;

wherein the first outer flange portion having the first plurality of ribs is located on the opposite side of the shaft as the second outer flange portion having the second plurality of ribs.

17. The valve plate of claim 16, further comprising a central axis, wherein the first plurality of ribs and the second plurality of ribs protrude away from the central axis in alternating fashion.

18. The valve plate of claim 16, wherein at least one of the first plurality of ribs extends into a slot of the shaft when the valve plate is assembled to the shaft.

19. The valve plate of claim 16, wherein at least one of the second plurality of ribs extends into a slot of the shaft when the valve plate is assembled to the shaft.

20. The valve plate of claim 15, further comprising a sliding fit, wherein at least a portion of the at least one support structure contacts at least one inner surface of the slot, achieving the sliding fit between the valve plate and the shaft.

21. The valve plate of claim 15, further comprising:

at least one assembly aperture integrally formed as part of the shaft;

at least one assembly aperture integrally formed as part of the at least one support structure; and a stand-off, the stand-off partially disposed in the at least one assembly aperture integrally formed as part of the shaft and partially disposed in the at least one assembly aperture integrally formed as part of the at least one support structure;

wherein a fastener extends through the at least one stand off, such that the fastener applies clamping force to the stand off and the valve plate when the valve plate is connected to the shaft.

* * * * *